United States Patent [19]

Robinson et al.

[11] 4,033,030

[45] July 5, 1977

[54] METHOD OF MANUFACTURING KEYSWITCH ASSEMBLIES

[75] Inventors: Max S. Robinson, Richland, Wash.; Thomas J. Studebaker, Boulder, Colo.

[73] Assignee: Mohawk Data Sciences Corporation, Herkimer, N.Y.

[22] Filed: Mar. 15, 1976

[21] Appl. No.: 666,732

Related U.S. Application Data

[62] Division of Ser. No. 505,389, Sept. 12, 1974, Pat. No. 4,018,999.

[52] U.S. Cl. ..... 29/622; 29/628; 156/230; 178/17 C; 179/90 K; 264/272; 200/5 A; 200/159 B

[51] Int. Cl.[2] ..... H01H 11/00

[58] Field of Search ..... 29/622, 628; 264/89, 264/90, 88, 272; 156/87, 228, 230, 232, 285, 286, 311, 382; 200/1 R, 5 R, 5 A, 11 R, 11 G, 11 H, 11 I, 11 K, 160, 159 B, 166 BH; 178/17 C; 340/365 A; 179/90 K

[56] References Cited

UNITED STATES PATENTS

| | | | |
|---|---|---|---|
| 3,722,086 | 3/1973 | Wikkerink et al. | 29/622 |
| 3,725,907 | 4/1973 | Boulanger | 200/159 B UX |
| 3,808,384 | 4/1974 | Boulanger | 200/5 A |
| 3,860,771 | 1/1975 | Lynn et al. | 200/5 A |
| 3,898,421 | 8/1975 | Suzumura | 200/159 B |

*Primary Examiner*—Victor A. DiPalma
*Attorney, Agent, or Firm*—Robert R. Hubbard

[57] ABSTRACT

A keyswitch assembly including a circuit board having a plurality of circuits, each circuit terminating with a pair of first and second contacts, and a curved, resilient contact plate associated with each pair of contacts having at least a portion of its periphery in communication with one of the pair of contacts, the plate being selectively deflectable so that it communicates with the other contact to close the respective circuit. The contact plates are fixed in position by a retaining element comprising a film formed by a layer of thermoplastic material bonded to a flexible sheet of insulative material, the thermoplastic material being bonded to the resilient plates and circuit board thereby maintaining the former in correct position relative to the latter. The method of manufacturing the assembly includes precisely locating the plates over the pairs of contacts, placing the retaining element over the circuit board an applying pressure to the assembly at an elevated temperature for a predetermined time.

13 Claims, 9 Drawing Figures

FIG. 1
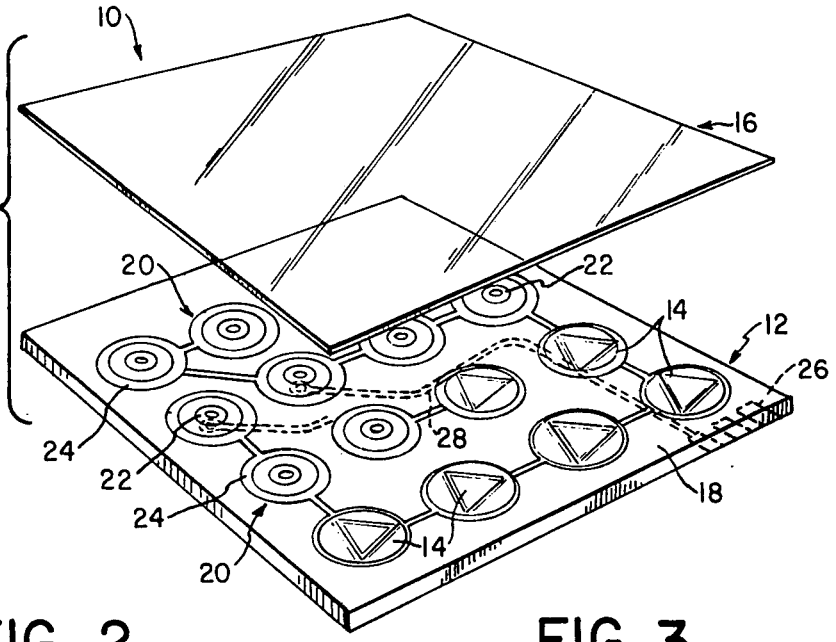
FIG. 2
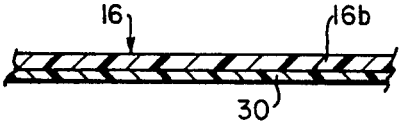
FIG. 3
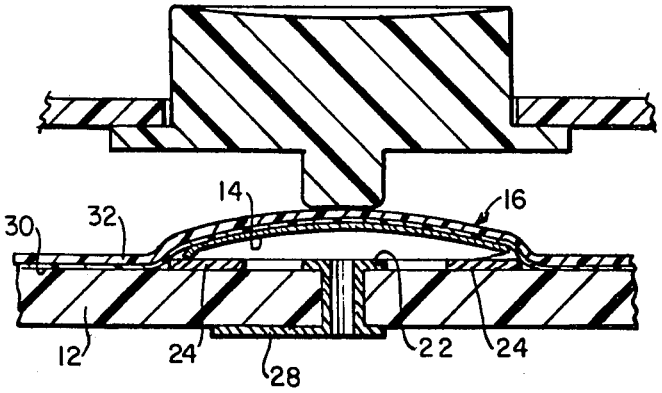
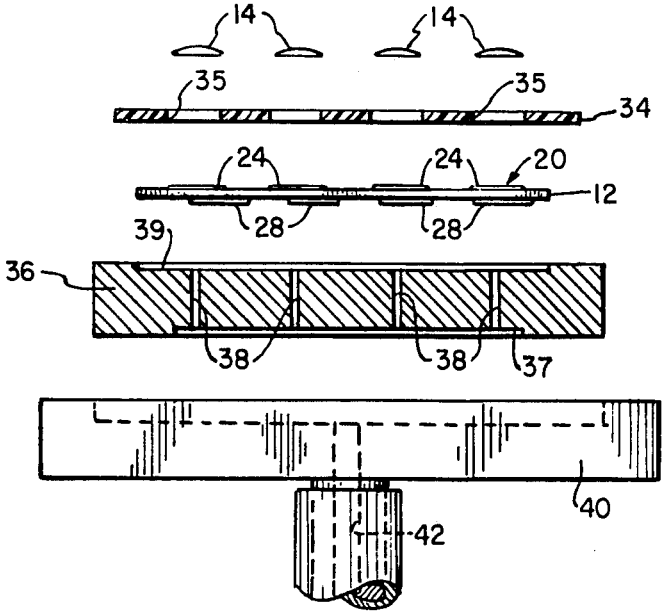
FIG. 4

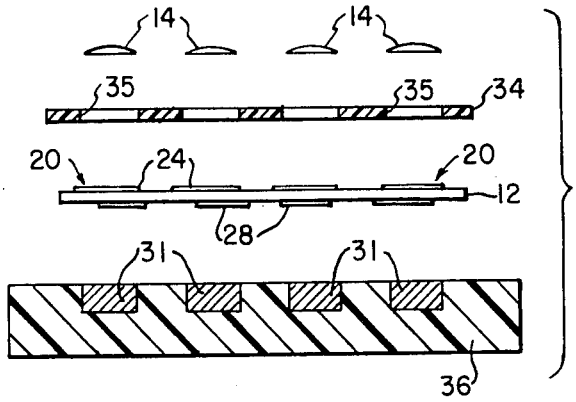
FIG. 5
FIG. 6
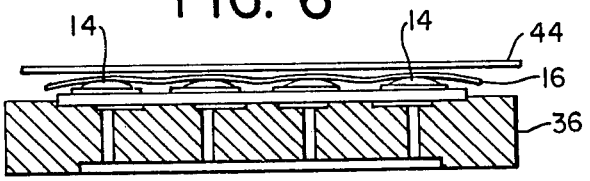
FIG. 7
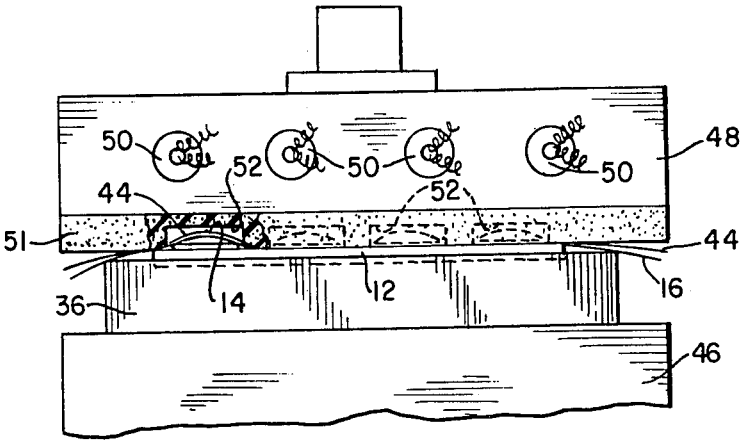
FIG. 8
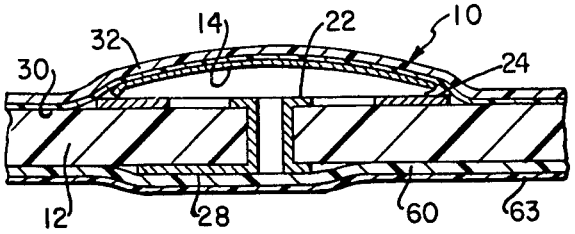
FIG. 9
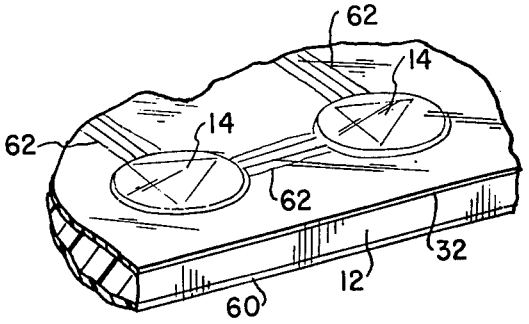

METHOD OF MANUFACTURING KEYSWITCH ASSEMBLIES

This is a division of application Ser. No. 505,389 filed 9/21/74, now U.S. Pat. No. 4,018,999.

BACKGROUND OF THE INVENTION

This invention relates generally to contact switch assemblies and methods for their manufacture, and more particularly to a contact switch assembly for use in a keyboard having one or more keys.

Presently available contact switch assemblies for use in keyboards generally include a printed circuit board having a plurality of circuits, each of which terminates with first and second contacts located proximately to each other. These printed circuit boards may have the circuit conductors provided only on the top or front surface of the board or, alternatively, on both the top and bottom surfaces in which case the circuit conductors are printed on the bottom or back board surface with the contacts extending through the board to the front surface through a plated hole or equivalent opening in the board. A resilient contact plate, such as a snap-acting dome, cooperates with each pair of contacts to perform the switching function in a known manner. The invention described below can be utilized with either type of printed circuit board and is not limited to use with the particular type illustrated in the drawings.

One of the difficulties involved in the above described contact switch assemblies has been the manner in which the snap-acting domes are fixed in position on the printed circuit board. Each dome must be precisely located and fixed in position so that at least a portion of its periphery electrically communicates with one of a pair of contacts so that, upon deflection, an inner portion of the dome will move into communication with the other contact thereby closing that particular circuit. A technique in current use for fixedly locating the domes comprises providing a thin sheet of polyester material or the like having a pattern of openings punched in it which precisely corresponds to the desired pattern of the domes on the circuit board. This type of sheet which may be called a "dome cage," an example of which is shown in FIGS. 4–6 of U.S. Pat. No. 3,749,859 granted to Webb et al. on July 31, 1973, has a pressure-sensitive adhesive layer on each of its surfaces so that subsequent to the punching operation, the cage is adhesively connected to the printed circuit board. The domes are then subsequently loaded into the individual locations defined by the openings in the cage and are thereby correctly positioned relative to the contact pairs. A cover sheet is then provided over the outwardly facing adhesive surface of the dome cage thereby completing the assembly which comprises the circuit board, the cage and the domes, whereupon the covered assembly may be heated and pressed to insure good adhesion between the cage and the printed circuit board. A precise second punching operation may be used subsequent to positioning the cover sheet to form mounting apertures and/or switch holes.

These dome cages, however, are not entirely satisfactory. The cost of the cage material, adhesives, and the labor involved in providing the adhesive on the cage material is relatively expensive. THe quality of the adhesive and cage material has been found to vary. Due to this inconsistency in quality of the adhesive and cage material, the punching process not infrequently causes the dome cage to crack or its surfaces to become contaminated with particles of adhesive and dome cage material. Relatively expensive and time-consuming cleaning and inspection steps are necessary in order to insure that these extraneous particles are kept to a minimum. Further, the openings formed in the dome cage must be precisely located with exact tolerances to assure proper electrical contact. This requires extensive, costly tooling equipment. If the temperatures occurring during the final heating step are too high, adhesive might flow into the dome area often resulting in malfunctioning. Additionally, if temperatures were too low, the final punching step frequently caused the circuit board to crack. Thus, a precisely controlled oven is required which adds yet further expense and additional time to the manufacturing process.

SUMMARY OF THE INVENTION

Accordingly, one object of this invention is to provide a new and improved contact switch assembly for keyboards.

Another object of the invention is the provision of a new and improved contact switch assembly which utilizes snap-acting domes.

Still another object of the present invention is to provide inexpensive apparatus for locating and maintaining the snap-acting domes in position.

A still further object of this invention is the provision of apparatus for retaining snap-acting domes in accurate position over the contacts formed on a printed circuit board.

Another still further object of the instant invention is the provision of a new and improved method of manufacturing contact switch assemblies for keyboards.

Still another further object of the instant invention is to provide a new and improved method for manufacturing contact switch assemblies for keyboards which is relatively inexpensive and less time-consuming than methods prevously employed.

Briefly, in accordance with a preferred embodiment of this invention, these and other objects are attained by first locating the snap-acting domes over respective pairs of contacts by one of various techniques, such as by vacuum. A retaining element comprising a film formed of a layer of thermoplastic material bonded to a flexible insulative material is positioned over the domes and circuit board after which the assembly is placed within a press. Pressure is applied at an elevated temperature for a predetermined time bonding the thermoplastic material to the domes and to the circuit board. A cover sheet may be provided over the back face of the circuit board with a foam layer interposed therebetween.

DESCRIPTION OF THE DRAWINGS

A more complete appreciation of the invention and many of the attendant advantages thereof will be understood by reference to the following detailed description when considered in connection with the accompanying drawings in which:

FIG. 1 is an exploded perspective view of the contact switch assembly in accordance with the present invention;

FIG. 2 is a detail side view in section of the retaining element for the contact switch assembly;

FIG. 3 is a side view in section of a portion of a printed circuit keyboard incorporating the present invention;

FIG. 4 is an exploded side view in partial section of the elements comprising the contact switch assembly and apparatus for positioning the same;

FIG. 5 is an exploded side view in partial section of the contact switch assembly elements and other apparatus for positioning the same;

FIG. 6 is a side view in partial section of the contact switch assembly elements in position prior to placement in a press;

FIG. 7 illustrates the contact switch assembly during the press operation;

FIG. 8 is a side view in section of a portion of the contact switch assembly having provisions for venting air trapped beneath the domes; and FIG. 9 is a broken away perspective view of a portion of the contact switch assembly having other provisions for venting air trapped beneath the domes.

DESCRIPTION OF THE PREFERRED EMBODIMENT

Referring now to the drawings and especially FIGS. 1 and 2, wherein like reference characters designate identical or corresponding parts throughout the several views, the contact switch assembly, generally denoted as 10, includes a printed circuit board 12, a plurality of curved resilient plates, hereinafter called domes 14 and an overlying retaining element 16 which fixedly maintains the domes in correct position on the printed circuit board as will be described below.

The printed circuit board 12 may be any of the well known types comprising a rigid board 18 formed of an insulative material usually in laminate form and a plurality of pairs of contacts 20. In the particular type of printed circuit board shown each pair of contacts includes a first contact 22 comprising a plated through hole in board 18 and a second contact 24 having a circular configuration. Each contact pair is electrically connected to a unique pair of electrical extensions 26 through associated conductors 28 formed on the reverse side of the board 18. The extensions 26 are connected to other circuitry (not shown) so that when a pair of contacts 20 are electrically connected, a particular circuit is closed which will generate a certain binary function. Although the particular circuit board illustrated in the drawings has conductors 28 printed on the reverse or back side of the board, it is understood that this invention may be used on other conventional printed circuit boards having conductors formed on the same surface as the contacts.

Snap acting resilient plates or domes 14 having a generally convex surface facing upwardly whose structure is well known in the art are provided on printed circuit board 12, each dome 14 having at least a portion of its periphery in communication with a second contact 24. Upon depression, a dome 14 will deflect so that a central portion of it will electrically communicate with a first contact thereby completing the respective circuit. Conversely, upon release, the dome will snap back to its normally open position. This invention is intended to be used with any one of a number of currently available configurations of snap acting contact plates of the type described.

This invention concerns accurately locating and fixing the domes 14 over respective contact pairs 20 and retaining these domes in position in a quick and inexpensive manner which assures the structural integrity of the printed circuit board. In currently available contact switch assemblies, the domes are located and fixed by a retainer or cage comprising an insulative board having a plurality of openings formed in it in the pattern of the contact pairs, the cage being adhesively fixed to the printed circuit board. After adhesively fixing the dome cage to the printed circuit board, the domes were merely placed in the openings thereby locating them relative to the contact pairs. The disadvantages associated with this technique, e.g., added expense and material, additional manufacturing steps such as laminating the cage material with adhesive, increased time for additional punching operations, the possibility of the printed circuit board cracking, added tooling and introduction of contaminants, made this technique rather unsatisfactory. The present invention comprises the use of a covering film or retaining element 16 formed of heat sealable thermoplastic material 30 such as polyvinylidine chloride, also known as Saran, preferably coated on a thicker film of thermoplastic material 16*b* such as polypropylene in lieu of the previously used dome cage and cover sheet. A coated film of this nature is available from Hercules Corporation and is known as 75Ga. type 501/1S coated film, a portion of which is shown greatly enlarged in FIG. 2.

Referring to FIG. 3, a portion of a keyboard incorporating a contact switch assembly constructed according to the present invention is illustrated. The retaining element 16 is bonded both to the domes 14 and to the printed circuit board 12 in a manner which will be described below with the Saran film 30 facing downwardly and bonded to the domes and printed circuit board. Saran has been found to be especially well suited for this application by virtue of the fact that it bonds extremely well both to the material of the printed circuit board and to the steel domes. The retaining element 16 maintains the domes fixed in position relative to the circuit board 12 so that at least a portion of their peripheries communicate with the circular second contacts 24 so that when a dome is depressed, its central portion will communicate with the associated first contact 22 thereby completing a circuit.

The method of constructing the contact switch assembly will now be described. Referrng to FIG. 4, the first step in the manufacture of the assembly is to temporarily precisely position the domes 14 on the printed circuit board 12 so that the outer edge of each dome seats upon a respective circular second contact 24 and so that an inner portion of the dome will communicate with the associated first contact 22 when the dome is depressed. A removable template 34 may be provided having a plurality of openings 35 formed in it which align with the circular second contacts 24. The template is appropriately positioned over the printed circuit board and the domes positioned within respective template openings. The template openings are slightly larger than the outer circumference of the domes so that the template may be removed once the domes have been positioned. To even further facilitate the handling of the printed circuit board with the domes positioned on it, a transfer base 36 may be provided. As shown in FIG. 4, the transfer base 36 is formed with a plurality of passages 38 formed therethrough arranged in a pattern which aligns with the configuration of the pairs of contact 20 on the printed circuit board. Additionally, a depression 39 substantially the same size as the P.C. board 12 is provided in the upper surface of the transfer base 36 to align this board with respect to the openings. The transfer base is associated with a vacuum pickup plate 40 connected by a conduit 42 to a vacuum source, a plenum chamber 37 being provided in the lower surface of the transfer base 36 to distribute the suction to the respective passages 38. The transfer base 36 positioned in the pickup plate 40 is placed adjacent to the underside of the printed circuit board 12 so that the domes 14 will be held fast to the printed circuit board since the air in the space under each dome is evacuated through the plated holes in the printed circuit board. The assembly is then ready for the pressing operation.

It is understood that other methods may be used to located the domes 14 in correct position on printed circuit board 12. As shown in FIG. 5, the transfer base 36 may be provided with magnetic members 31 in lieu of (or, in an embodiment no shown, in conjunction with) the passages 38 shown in FIG. 4. Each magnet 31 is positioned directly beneath a contact pair 20 so that the associated dome 14 will be magnetically held in position.

Referring to FIG. 6, the template 34 is removed and the retaining element 16 which in the preferred embodiment comprises a Saran coated film of polyporpylene is placed on the domes and printed circuit board with the Saran coating facing the printed circuit board. As mentioned above, a film found to work well is Hercules No. 75Ga. Type 501/1S film which comprises a polyporpylene film of one half mil thickness coated with a quarter mil coating of Saran (polyvinylidine chloride). The Saran coating is necessary since the polypropylene alone will not heat bond to both the domes and the printed circuit board. It is understood, however, that other materials than the ones above specified may be used in accordance with this invention including any heat sealable thermoplastic material. The assembly with the retaining element 16 loosely draped over it is now ready for the press operation.

Referring to FIGS. 6 and 7, prior to placement within the press, a barrier sheet 44 is placed over the retaining element 16 in order to prevent the press platen from sticking to the polypropylene film during the heat bonding of the film to the domes and printed circuit board. A 2 mil thick Teflon film has been used as such a barrier sheet. A conventional heated press apparatus is employed comprising a fixed press base 46 and an upper platen 48 through which the pressure is applied. Upper platen 48 is heated electrically via heating elements 50 during operation. A silicone rubber layer 51, preferably approximately one-eighth inch thick, is provided over the lower surface of the upper press platen 48 in order to conform to the surface irregularities on the printed circuit board caused by the printed conductors. A plurality of reliefs 52 are cut out of the silicone rubber layer in a pattern adapted to align with the domes. Each relief is of a height slightly smaller than the height of the domes so that, upon operation of the press, the silicone layer will exert sufficient pressure on the domes to bond the retaining element 16 to the domes but insufficient to snap the domes into their closed mode. The assembly comprising the transfer base 36, printed circuit board 12, domes 14, retaining element 16 and barrier sheet 44 is placed on the press base 46 in a predetermined position and the platen pressure is applied for a predetermined time at a predetermined temperature bonding the Saran coated retaining element 16 to the domes and printed circuit board thereby fixing the former with respect to the latter. The upper platen is then released and the barrier sheet 44 removed. The retaining element 16 conforms to the curved surface of the contact domes and bonds to them with sufficient force to maintain their operating position without a dome cage.

The film bonding is accomplished by an intimate contact of the film of heat sealable thermoplastic material and the printed circuit board surface with sufficient heat and pressure to cause molecular transfer or "surface wetting" as evidenced by a measurable peel strength between the film and laminate surface. The transient heat transfer from the platen through the films to the printed circuit board laminate is quite complex to analyze, but in general, the air between the platen surface, the barrier sheet, the retaining element and the printed circuit board presents a barrier to the transfer of heat. This air is expelled during the pressing operation so that heat is readily transferred to the retaining element and printed circuit board surface until the Saran reaches a "flow" temperature and wets or bonds to the laminate. This wetting or bonding improves the heat transfer rate between the retaining element and the printed circuit board, allowing heat to be transferred from the polypropylene film. A combination of the "heat sinking" provided by the printed circuit board and the naturally poor thermal transfer through the silicone rubber of the platen tends to prevent overheating of the bonded film.

The temperatures and pressures used during the process depend upon the particular materials of which the retaining element 16 and printed circuit board 12 are constructed. The main requirement is that a predetermined "peel strength" be achieved. As used herein, peel strength refers to the maximum pull force registered on a gauge whose end is attached to a corner of a film bonded to a board as the corner of the film is pulled perpendicularly to the board divided by the length of the boundary line between the attached and free film surfaces. The minimum bonding strength acceptable to maintain the domes in proper position should exceed approximately 8 ounces per inch although bonding having a peel strength somewhat lower may still be used.

For the materials included in the preferred embodiment, the minimum temperature for adequate bonding is approximately 275° F, but increased pressure and time of bonding will result in adequate bonds formed at lower temperatures. The maximum temperature, based on heat distortion of the polypropylene film, is approximately 290° F but the heat sinking provided by the printed circuit board allows platen surface temperatures as high as 400° F. A major function of the pressure applied by the press is the reduction of areas on the printed circuit board which are unbonded to the retaining element 16 resulting from the printed conductors or variations in thickness of the printed circuit board itself. Another function of the applied pressure is increased heat transfer from the platen to the bonding surface which correspondingly decreases the time required for bonding. The lower limit of pressure for small printed circuit boards (approximately 3 × 5 inches) has been found to be approximately 25 p.s.i. which would require 15 seconds of pressure at 300° F to obtain a bond having a peel strength of 11.7 ounces per inch. The upper limit, based upon the strength of the printed circuit board is well above 300 p.s.i., but increasing pressure compresses the silicone rubber on the platen nullifying the inset relief cavities formed in the silicone rubber layer. Thus, it is seen that various pressures and temperatures may be employed in the bonding process depending upon the particular heat sealable thermoplastic material employed in the retaining element 16 to give a minimum peel strength of approximately 8 ounces per inch. When using a Saran coated polypropylene film as the retaining element 16, a particular example bonding the film at a pressure of about 25 p.s.i. at a temperature of about 300° F for 15 seconds to achieve a peel strength of 11.7 ounces per inch. Of course, the invention is not limited to these particular parameters but is broad enough to cover bonding procedures using temperatures and pressures resulting in bond strengths sufficient to maintain the domes in position over the respective contacts.

The preferred embodiment described above uses the invention in conjunction with a printed circuit board having plated-through holes. In such a case, the retaining element may be completely bonded to the board in the areas surrounding the domes and still function properly in that upon depression of a dome, the air trapped in the area between the domes and the printed circuit board is expelled through the plated-through hole. However, in the cases of a printed circuit board having a configuration not utilizing plated through holes or when such a plated-through circuit board is utilized but where the back of the board is sealed, problems arise if the air held in the above defined area cannot be vented. This trapped air tends to act as a cushion to dampen or deaden the snapping action of the domes. Where a plated-through circuit board is used whose back side is sealed, a layer of foam material such as polyurethane 60 (FIG. 8) may be provided on the bottom surface of the printed circuit board during the heat sealing operation to allow any air trapped in the domes to escape into the foam. A Mylar film 63 is preferably provided over the foam layer 60 to prevent contamination. Alternatively, by providing shallow depressions in the silicone rubber layer of the press which communicate between adjacent dome recesses, strips of the retaining element will remain unbonded after the processing operation, which define air passages 62 (FIG. 8) communicating between adjacent domes. Thus, when a dome is depressed, the air contained beneath it enters an air passage 62 allowing the snap action to occur. The practical upper limitation of the platen surface temperature may be limited to approximately 350° F based upon shrinkage of unbonded film defining such air passages between contact domes.

Numerous variations and modifications of this invention are possible in the light of the above teachings. For example, other materials may be used for retaining element 16 and other times, temperatures and pressures may be utilized than those discussed depending upon the desired bond strengths of the retaining element to the printed circuit board. It is therefore to be understood that within the scope of the appended claims the invention may be practiced otherwise than as specifically described herein.

What is claimed is:

1. A method of manufacturing a contact switch assembly for a keyboard comprising a circuit board having at least one first contact and at least one second contact provided on one side of said board, at least one electrically conductive curved resilient plate selectively electrically communicating between pairs of said first and second contacts and a retaining element comprising a film including a heat sealable thermoplastic material which maintains said resilient plates in position, comprising the steps of:

locating said electrically conductive curved resilient plates over said one side of said circuit board with at least a portion of their peripheries in electrical communication with respective ones of said second contacts;

placing said retaining element over said one side of said circuit board, said heat sealable thermoplastic material being in contact with said resilient plates and said circuit board side;

placing the assembly in a press and applying pressure to the assembly at an elevated temperature for a predetermined time thereby bonding said heat sealable thermoplastic material to said plates and to said one circuit board side; and removing the assembly from the press.

2. The method as recited in claim 1 wherein subsequent to removing the assembly from the press, the step of applying a back cover sheet on the other side of said circuit board.

3. The method as recited in claim 1 wherein the pressure applied is in the range of about 20 to 200 p.s.i. at a temperature in the range of about 250° to 450° F for a time in the range of about 2 to 15 seconds.

4. The method as recited in claim 1 wherein said heat sealable thermoplastic material is polyvinylidine chloride.

5. The method as recited in claim 1 wherein said flexible insulative material is polypropylene.

6. The method of claim 1 wherein the step of locating the plurality of plates on said circuit board includes providing at least one magnet on the other side of the circuit board in registration with respective ones of said first contacts, each magnet adapted to hold a plate in position during placement of the retaining element.

7. The method of claim 6 further including the step of applying a vacuum source through apertures formed in said magnets to further facilitate location of said plates.

8. The method of claim 1 wherein the step of locating the plates on said circuit board includes providing apertures in said circuit board at areas corresponding to said first contacts and applying a vacuum source through said apertures to locate said plates.

9. The method of claim 1 wherein the step of locating the plates on said circuit board includes positioning a template over said one circuit side having a plurality of openings formed therein which align with said first and second contacts and placing one of said plates into each of said openings.

10. The method of claim 1 wherein the pressure, time and temperature of the bonding step are chosen so that the retaining element has a bond peel strength to said circuit board greater than 6 ounces per inch.

11. The method of claim 1 wherein the pressure is in the range of about 25 to 200 p.s.i. and the temperature is in the range of about 250° to 450° F.

12. The method of claim 1 further including the step of placing a layer of foam material beneath the circuit board subsequent to removing the assembly from the press.

13. A method of manufacturing a keyboard system having an insulative circuit board and a plurality of switches arranged on one face of the board, each switch comprising a pair of spaced contacts on the board and a resilient deformable actuating element for being selectively deformed to engage both of its respective contacts to thus complete a circuit therebetween, said method comprising the steps of:

arranging a plurality of said actuating elements in position relative to one another corresponding to the desired locations of said elements on said circuit board; and adhering a sheet of flexible insulative material to the outer faces of said elements and to said one face of said circuit board so as to secure each of said elements to said board in proper position relative to its respective contacts and to seal the elements to the circuit board.

* * * * *

Disclaimer 4,033,030.—*Max S. Robinson*, Richland, Wash., and *Thomas J. Studebaker*, Boulder, Colo. METHOD OF MANUFACTURING KEYSWITCH ASSEMBLIES. Patent dated July 5, 1977. Disclaimer filed Feb. 10, 1978, by the assignee, *Mohawk Data Sciences Corp.*

The term subsequent to Apr. 19, 1994 has been disclaimed.

[*Official Gazette April 18, 1978.*]